United States Patent [19]

Carlson et al.

[11] 4,124,176

[45] Nov. 7, 1978

[54] SELF-TENSIONING REEL

[75] Inventors: John C. Carlson, Rockaway; Jeremia P. Starace, Randolph, both of N.J.

[73] Assignees: Western Electric Company, New York, N.Y.; Bell Telephone Laboratories, Incorporated, Murray Hill, N.J.

[21] Appl. No.: 861,300

[22] Filed: Dec. 16, 1977

[51] Int. Cl.[2] ..... B65H 59/04

[52] U.S. Cl. ..... 242/156; 242/115; 242/118.62

[58] Field of Search ..... 242/156, 128, 129, 129.8, 242/75.4, 75.43, 79, 77, 118.4, 118.62, 115, 116

[56] References Cited

U.S. PATENT DOCUMENTS

| | | | |
|---|---|---|---|
| 1,451,131 | 4/1923 | Weber | 242/118.62 |
| 1,949,378 | 2/1934 | Roehm | 242/118.62 |
| 2,916,225 | 12/1959 | Swallow et al. | 242/118.52 UX |
| 3,156,324 | 11/1964 | Colbert | 242/156 |
| 3,326,495 | 6/1967 | De Bruyn | 242/129 |
| 3,603,526 | 9/1971 | Payne et al. | 242/156 X |
| 3,796,392 | 3/1974 | Starace | 242/156 |
| 3,830,445 | 8/1974 | Moore | 242/129 X |
| 4,026,495 | 5/1977 | Bartelt | 242/156 X |

*Primary Examiner*—Stanley N. Gilreath
*Attorney, Agent, or Firm*—Robert O. Nimtz

[57] ABSTRACT

A self-tensioning wire reel comprises two flanges threaded together such that, when a brake shoe applies a braking force to one flange, the other flange is free to continue rotating. This rotation on the threaded hubs brings the flanges closer together, exerting a lateral force on the wire coil therebetween and thus keeping the coil sufficiently tight to prevent binding during the unreeling operation. The brake shoe is a resilient cylindrical disk applied to the outer rim of one flange when tension is relieved on the wire. The tightness of fit between the disk brake and the shaft upon which it rotates controls the frictional braking force.

7 Claims, 4 Drawing Figures

SELF-TENSIONING REEL

BACKGROUND OF THE INVENTION

1. Field of the Invention

This invention relates to coil handling apparatus and, more particularly, to a self-braking and self-tensioning coil reel.

2. Description of the Prior Art

Unreeling operations of coiled materials are often necessary in industrial situations. Telephone central offices, for example, use wire for making cross-connections on the main distributing frame and for similar applications. Coils of wire are mounted on a reel and wire is removed from the reel by pulling on the wire and causing the reel to rotate and unwind the wire. In order to prevent wire overrun and consequent entanglement and wastage of wire, a brake is provided on the reel for stopping the rotation of the reel when the pulling force is removed from the wire.

One type of wire reel brake, shown in J. P. Starace U.S. Pat. No. 3,796,392, granted Mar. 12, 1974, utilizes a resilient braking disk mounted to apply a braking force on the inner surface of the reel flange by the flat surface of the disk. The brake arm and shoe assembly is pivotally mounted on a base and is held away from the reel flange by the tension on the wire caused by the removal force as the wire is unreeled. Removal of this tension force allows the rotation of the brake arm assembly to bring the face of the brake disk against the inner face of the reel flange. Subsequent rotation of the reel wedges the braking shoe into contact with the flange surface to stop the rotation. The frictional braking force with this arrangement is determined by the disk material and cannot be adjusted.

Coils of wire for use with wire reels come in various thicknesses and hence an adjustable reel is desired for receiving such coils. Moreover, as the wire is removed from the coil, the coil configuration becomes shorter along its axis of rotation. Looseness in the coil wire on the reel permits the portion of wire being unwound under tension to become embedded in and bind in these loose coils, thereby interfering with the unreeling operation.

An adjustable reel is shown in J. E. Moore U.S. Pat. No. 3,830,445, granted Aug. 20, 1974, in which the two flanges are threaded together on a coil spring. Manual threading of the flanges together permits adjustments for various widths of coils and permits manual width adjustments during unreeling to maintain lateral tension on the coil. The spring provides a resilient lateral tensioning force. Such a reel, however, requires manual adjustment at various times during the unreeling operation.

SUMMARY OF THE INVENTION

In accordance with the illustrative embodiment of the present invention, automatic braking and lateral tensioning are provided by a wire reel having two telescoping flanges threaded together and a self-locking cylindrical disk brake bearing on the rim of one flange. The tightness of the fit of the brake shoe on its shaft can be adjusted to change the braking force or slippage permitted between the braking material and the flange rim. The brake arm assembly is pivotally mounted so as to be held clear of the flange rim as long as tension is maintained on the wire. Release of this tension permits the brake shoe to come into contact with the flange rim and, by a wedging action, exert sufficient frictional force to bring the flange to a stop. The inertia of the other reel flange allows it to continue rotation due to centrifugal force and, in doing so, to move laterally toward the braked flange under the influence of the threads at its hub.

It can be seen that the wire reel of the present invention is not only self-braking, but is also self-tensioning due to the lateral movement of the unbraked flange. Since this movement can occur each time the reel is braked, the proper lateral tension is maintained on the coil at all times throughout the unreeeling operation. No manual adjustments are required. Coils can be inserted on the reel simply by turning the unbraked flange in such a direction as to unscrew this flange from the braked flange, separating the flanges, inserting the new coil, and turning the unbraked flange back onto the braked flange.

Although this invention has direct application in the wire coil reeling art, it is also applicable to other reeling operations such as sewing thread unreeling, weaving, wire stock unreeling, rope manufacturing and cable reeling. The size of the reel and the type of material on the reel do not affect the self-braking and self-tensioning capabilities.

DETAILED DESCRIPTION

Figure 1:
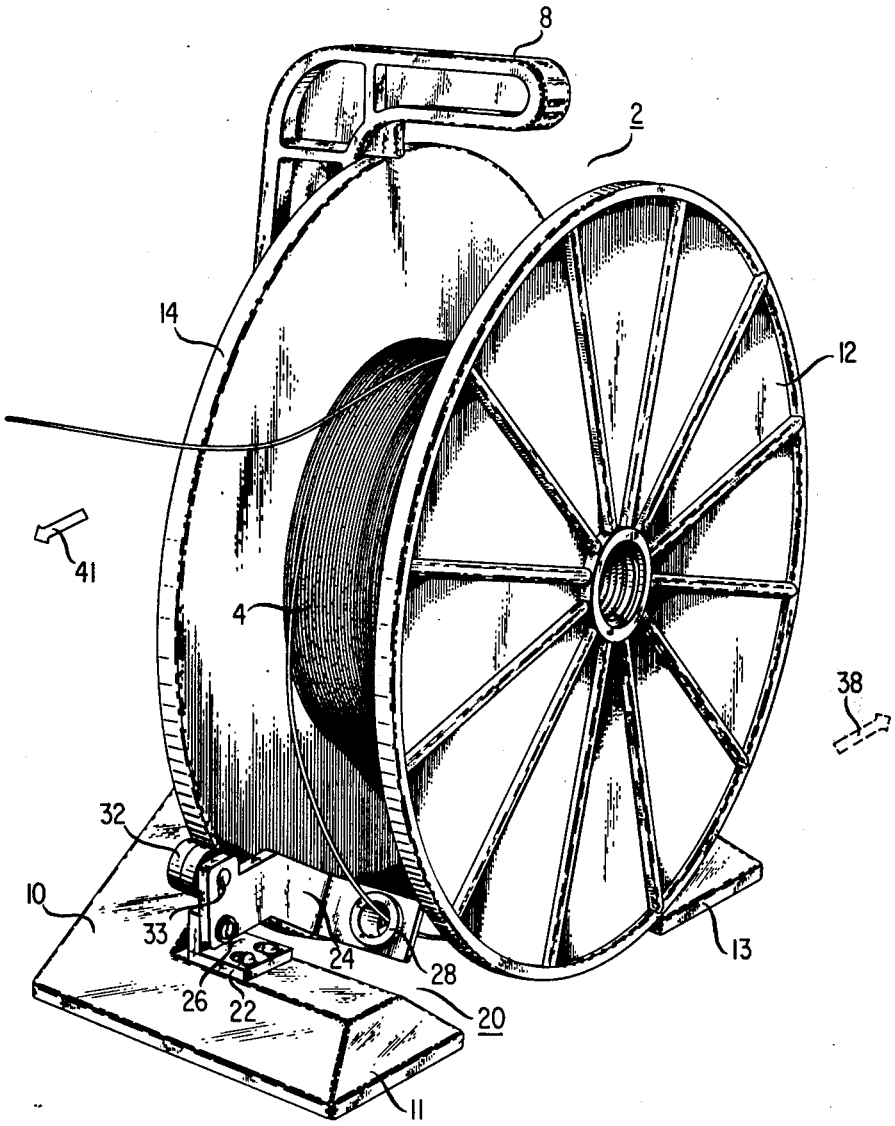
FIG. 1 is a perspective view of a self-braking and self-tensioning reel assembly in accordance with the present invention.

FIG. 1 shows a wire reel 2 having a wire coil 4 wound thereon and rotatably mounted on a shaft 6 (shown in FIG. 2) affixed to a support arm 8. Support arm 8 is mounted to a base 10 having supporting feet 11 and 13, which may have a slip-resistant lower surface. Wire reel 2 includes two generally circular flanges 12 and 14 for preventing wire coil 4 from spilling from the edges of reel 2. The inner or opposing surfaces or faces of flanges 12 and 14 are generally planar, smooth surfaces. A brake 20 is utilized for arresting the rotation of reel 2 and thereby controlling the winding or unwinding of wire 4 on reel 2. As shown more clearly in FIG. 2, brake 20 comprises a base 22 adjustably mounted to base 10 and having a brake arm 24 pivotally mounted thereon by a pin or shaft 26. Arm 24 has a right angled portion including a ceramic-lined wire guide 28 therein. At the other end of arm 24 there is mounted a generally disk-shaped brake shoe 32 mounted on a shaft 33. Shoe 32 can comprise any of the well-known varieties of friction materials.

Brake 20 is mounted to shaft 26 substantially parallel to the shaft 6 of reel 2. Arm 24 is positioned between flanges 12 and 14 and the brake shoe 32 is generally aligned with the rim of flange 14. Wire guide 28 is located in a generally central position between flanges 12 and 14. The weight of arm 24 normally pivots arm 24 on shaft 26 so as to bring brake shoe 32 into contact with the rim of flange 14. As shown in FIG. 1, however, the wire from coil 4 is threaded through guideway 28 and, when tension is applied to wire 4 in either of the directions indicated by arrows 38 or 41, a vertical component of that tension raises arm 24 and moves brake shoe 32 away from flange 14.

Wire being removed from reel 2 is fed through guide 28 to supply the vertical component which releases brake shoe 32. Thus, reel 2 is free to rotate and unwind wire coil 4 in response to tension on the wire. When the tension on wire 4 is removed, arm 24 rotates under its own weight on shaft 26 until the periphery of brake shoe 32 establishes contact with the rim of flange 14. Subsequent rotation of reel 2 forces the brake disk 32 to be wedged into a braking contact with the rim of flange 14 and thereby applies a relatively large braking force to the reel. When a tension or removal force is reapplied to wire 4, arm 24 is again pivoted upward to remove brake disk 32 from braking contact with the rim of flange 14. This permits reel 2 freedom to rotate.

If reel 2 is rotated in the opposite or rewind direction (clockwise), the wedging action does not take place and brake 20 applies a negligible braking force to oppose the rewinding operation.

Figure 4:
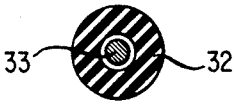
FIG. 4 is an enlarged cross-sectional view of the brake disk and brake disk shaft of the brake assembly shown in FIGS. 1 and 2.

The actual amount of braking force applied to the rim of flange 14 can be adjusted, as shown in FIG. 4, by adjusting the clearance between braking disk 32 and shaft 33. Since the circular brake shoe 32 rotates on shaft 33 when it engages the moving flange 14, the braking action is governed by the difference in frictional forces of disk 32 rotating on shaft 33 and rubbing on the rim of flange 14. If the brake shoe 32 is press-fit to shaft 33, little slippage takes place around shaft 33 and the braking force applied to the rim of flange 14 is greater. At some point, the braking action becomes self-locking and the reel 2 jerks to an immediate stop. With a clearance fit on shaft 33, deceleration is smooth and constant. Such a smooth deceleration is preferred since variations in tension or temporary removal of the tension on wire 4 does not cause the reel 2 to come to a jerking stop.

Figure 2:
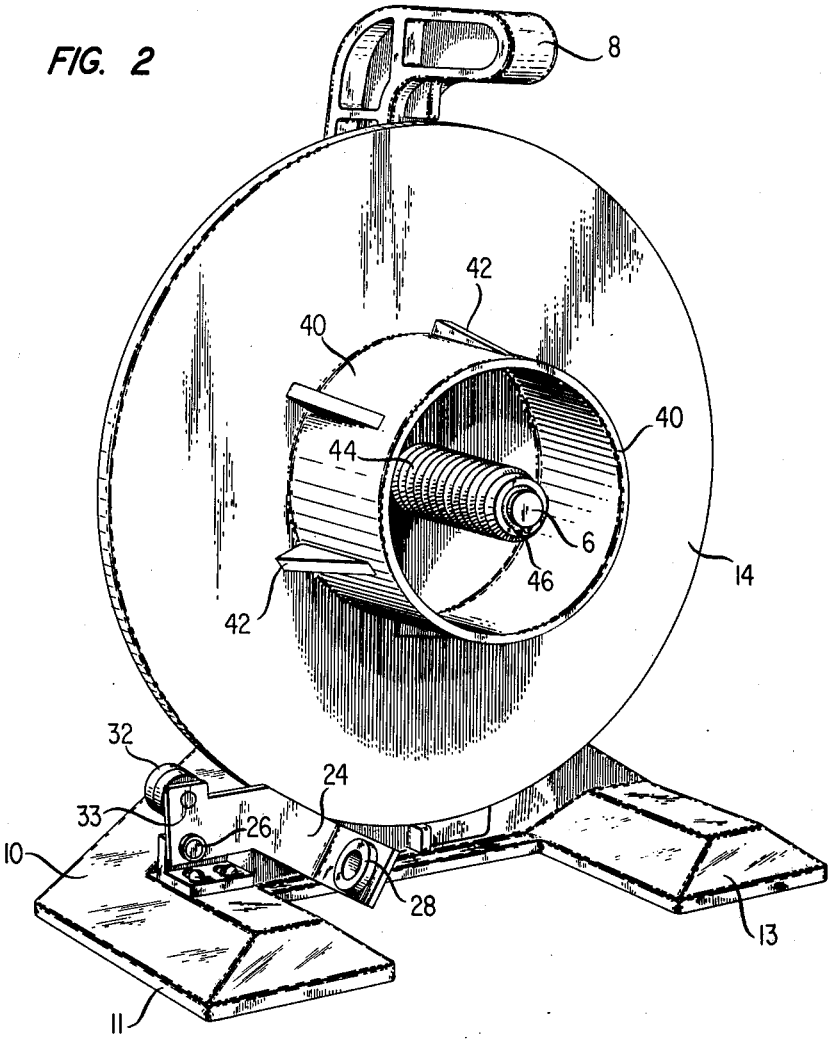
FIG. 2 is a perspective view of a partial assembly of the reel of the present invention showing the details of the hub of the braked flange.

In FIG. 2 there is shown a partial assembly of the reel 2 with the outer flange 12 removed as well as the wire coil 4. It can be seen that the hub 40 of flange 14 has a number of wedged-shaped ribs 42 on the outer periphery thereof. The outer envelope of ribs 42 conforms to the inner contour of wire coil 4 and thus ensures a snug fit of the coil core. Flange 14 also includes a threaded bushing 44 through which shaft 6 extends. Flange 14 is attached to shaft 6 by a snap ring 46 and is therefore free to rotate on shaft 6.

Figure 3:
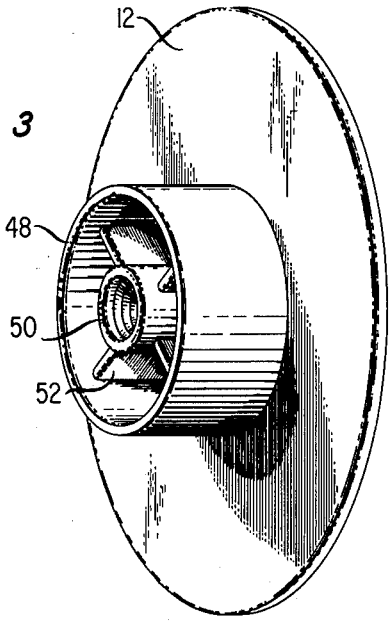
FIG. 3 is a perspective view of the unbraked flange showing the details of the hub of the unbraked flange.

In FIG. 3 there is shown the outer flange 12 disassembled from the reel to show the outer hub 48 having a diameter which permits it to telescope into hub 40 of flange 14. Within outer hub 48 is an internally threaded inner hub 50 designed so that the internal threads mate with the external threads on bushing 44. Inner hub 50 is supported by a plurality of ribs 52 extending from hub 50 to hub 48.

It will be noted that reel 2 is designed to rotate in a counterclockwise direction during unreeling operations. The threads on bushing 44 and hub 50 are such that flange 12 moves towards flange 14 when flange 12 is rotated in a counterclockwise direction with respect to flange 14. Outer flange 12 can be removed from inner flange 14 by turning flange 12 in a clockwise direction. This permits the removal of flange 12 and the insertion of a wire coil 4 over the hub 40 of flange 14. Outer flange 12 can then be reaffixed to inner flange 14 by turning flange 12 in a counterclockwise direction.

During operation, when inner flange 14 is decelerated by the braking action of brake 20, outer flange 12 tends to continue counterclockwise rotation in response to centrifugal force. This counterclockwise rotation with respect to inner flange 14 moves flange 12 on its threaded hub toward flange 14. The lateral movement of outer flange 12 toward flange 14 maintains a constant lateral force on coil 14, preventing the wires of coil 4 from becoming loose during the unreeling operation. In accordance with the present invention, this lateral tensioning takes place automatically in response to normal braking and without intervention of an operator.

It will be noted that flanges 12 and 14 include no open spaces which would provide safety hazards for personnel using the reel. In the preferred embodiment, the flanges 12 and 14, support arm 8 and base 10 are fabricated from foamed plastic by a foam molding technique to reduce the weight and cost of the reel assembly. A material suitable for this purpose is a thermoplastic polycarbonate manufactured by the General Electric Company under the trade name "Lexan."

It will be noted that the self-braking and self-tensioning properties of the reel of the present invention are independent of the size of the reel or the nature of the coiled material being unreeled. The present invention may therefore find application for very small reels, such as spools of thread in a sewing or weaving application, and for very large reels, such as in a telephone cable reels or wire stock feed reels for automatic screw machines.

What is clamed is:

1. A self-tensioning and self-braking reel for unwinding coiled stock mounted on a reel hub extending between two reel flanges characterized by a brake for applying a braking force to one of said flanges in response to the relief of unreeling tension on said coiled stock, and mated threads axially located on said two flanges and adapted to be automatically threaded together to permit lateral compression of said coiled stock when the other of said flanges rotates independently in an unreeling direction in response to said braking force on said one flange.

2. The reel according to claim 1 characterized in that said brake comprises a base, a brake arm pivotally mounted on said base and having the center of gravity thereof located to cause said arm to rotate toward said base, a circular brake shoe mounted on one end of said arm and adapted to apply a braking force to the outer rim of said one flange, and a shaft for said brake shoe providing sufficient clearance between said shaft and said brake shoe to permit rotation of said brake shoe on said shaft.

3. The reel according to claim 2 characterized in that said brake arm includes a guideway for said stock through which said stock is threaded to provide a force on said brake arm to disengage said brake shoe from the rim of said one flange when unreeling tension is applied to said stock.

4. The reel according to claim 1 characterized in that said hub comprises coil supporting ribs on a first of said flanges and a telescoping protrusion on the second of said flanges.

5. A reel for wire coils comprising a hub for supporting said wire coils, a first flange on one end of said hub, a braking mechanism for braking said first flange, a second flange mounted to said first flange at the other end of said hub by screw threads pitched to automatically close said second flange toward said first flange in response to braking of said first flange.

6. The reel according to claim 5 wherein said braking mechanism comprises a braking shoe, a pivoted brake arm adapted to bring said brake shoe against said first flange under the force of gravity, and means in combination with said brake shoe for adjusting the braking force applied by said brake shoe.

7. The reel according to claim 6 wherein said braking force adjusting means comprises a brake shoe shaft, and a cylindrical disk-shaped braking shoe mounted on said shaft and having a preselected clearance between said shaft and said shoe.

* * * * *